United States Patent [19]

McClellan

[11] 4,332,361

[45] Jun. 1, 1982

[54] BAG HOLDER SUPPORT SYSTEM

[76] Inventor: Thomas A. McClellan, 8888 Riverside Dr. East, Windsor, Ontario, Canada, N8S 1H2

[21] Appl. No.: 221,535

[22] Filed: Dec. 31, 1980

[51] Int. Cl.[3] ..... B65B 67/12

[52] U.S. Cl. ..... 248/95; 248/99

[58] Field of Search ..... 248/95, 97, 98, 99, 248/100, 101, 311.2; 150/51; 141/391; 53/390

[56] References Cited

U.S. PATENT DOCUMENTS

| | | | |
|---|---|---|---|
| 234,012 | 11/1880 | Fish | 248/99 X |
| 2,188,047 | 1/1940 | Jones | 248/99 |
| 3,186,667 | 6/1965 | Mever | 248/99 X |

FOREIGN PATENT DOCUMENTS

| | | | |
|---|---|---|---|
| 120020 | 10/1970 | Norway | 248/100 |
| 598057 | 4/1978 | Switzerland | 248/100 |
| 1262956 | 2/1972 | United Kingdom | 248/99 |
| 1494835 | 12/1977 | United Kingdom | 248/101 |

*Primary Examiner*—J. Franklin Foss

*Attorney, Agent, or Firm*—Barnes, Kisselle, Raisch & Choate

[57] ABSTRACT

A bag holder support system comprising a pair of brackets adapted to be mounted on a wall or door. Each bracket has a horizontal portion with a central upwardly extending portion for receiving the handle opening in one side of a bag, the bag having spaced oppositely extending walls with a handle portion formed by an opening in the walls. The portions of the bracket which extend horizontally away from the upwardly extending portion of each bracket thereby suspend one wall of the bag. Members are mounted on each bracket and are movable into position after a bag is suspended on the bracket to hold the wall of the bag in position and maintain the wall so that the bag is held open.

15 Claims, 4 Drawing Figures

BAG HOLDER SUPPORT SYSTEM

This invention relates to the holding of plastic or similar bags in position for loading.

BACKGROUND AND SUMMARY OF THE INVENTION

In the merchandising of goods in commercial establishments, it has recently become common to utilize plastic bags in lieu of paper bags. Such bags include a handle portion formed by openings in the upper ends of opposed walls of the bag. When such bags are brought to the home of the consumer, they are often used for disposal of refuse. The present invention is directed to a bag holder system which can be used preferably in the home for supporting such bags in open position for receiving the refuse; which system is simple, inexpensive and effectively hold the bags in open position.

In accordance with the invention the bag holder support system comprises a pair of brackets, each bracket having a horizontal portion with a central upwardly extending portion for receiving the opening of one side of a bag. Each bracket includes portions extending horizontally away from the upwardly extending portion of each bracket thereby suspending one wall of the bag. The brackets are adapted to be mounted on a wall, door or the like. Means on each bracket is movable into position after a bag is suspended on the bracket to hold the wall of the bag in position and maintain the wall so that the bag is held open.

DESCRIPTION

Figure 1:
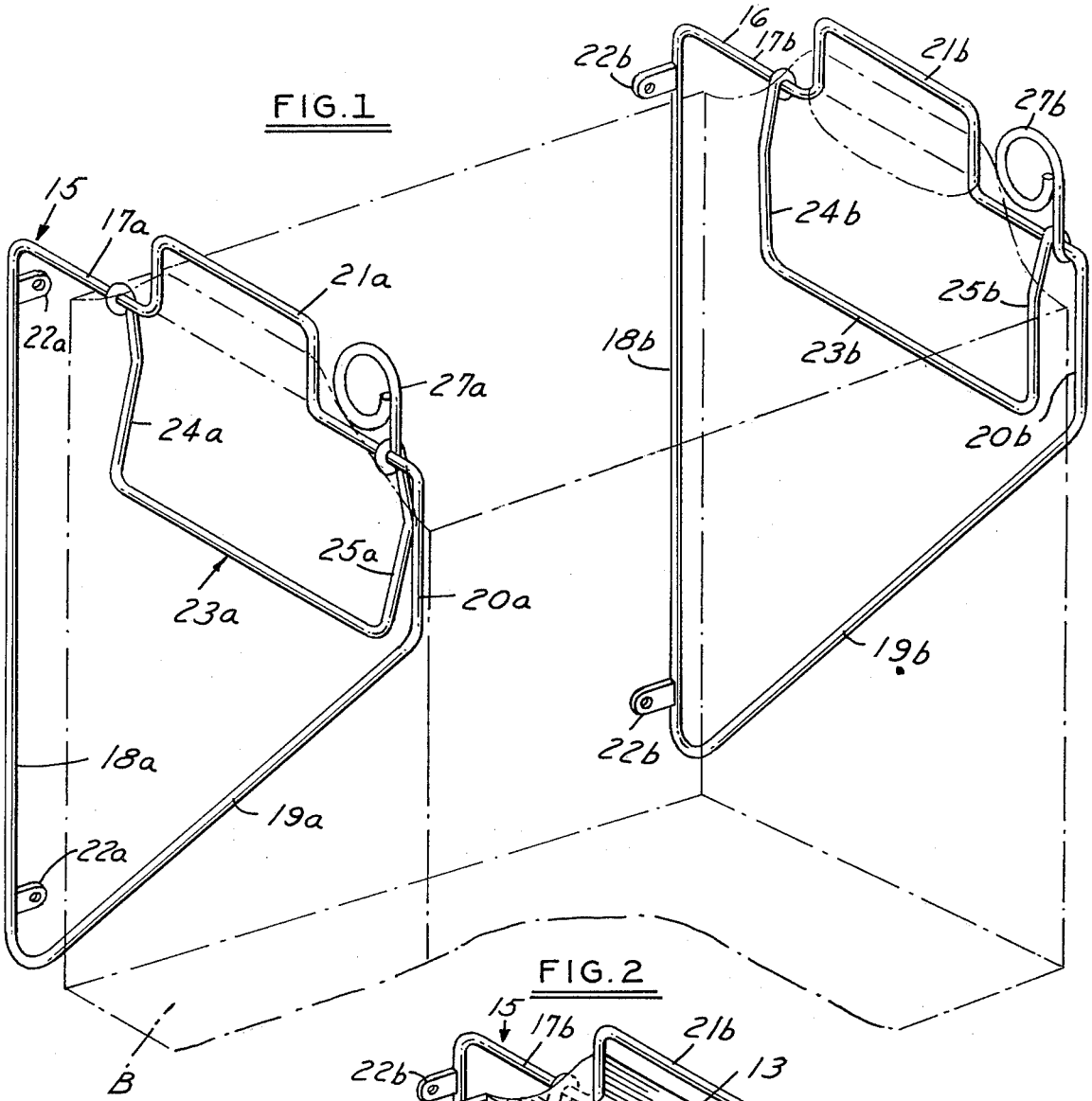
FIG. 1 is a perspective view of the bag holder support system embodying the invention.

Referring to FIGS. 1–4, the bag support system embodying the invention is intended to be used on a wall or door to support a bag B having side walls 10 and end walls 11. Each end wall 11 is formed with an opening 12 along the top of the end walls forming a handle 13. Such bags are commonly made of plastic.

In accordance with the invention, the bag support comprises a pair of brackets 15, 16 which are mirror images of one another and are adapted to be mounted on a wall or a door of a cabinet or the like. Each bracket 15, 16 is made of wire and includes a generally horizontally top portion 17*a*, 17*b*, a vertical rear portion 18*a*, 18*b*, an upwardly inclined portion 19*a*, 19*b*, and a front vertical portion 20*a*, 20*b*. An intermediate portion of the top horizontal portion 17*a*, 17*b* is bent upwardly into the form of a projection which is U-shaped at 21*a*, 21*b*. Tabs 22*a* are provided on vertical portion 18*a* and tabs 22*b* are provided on vertical portion 18*b* as by welding and each has an opening for receiving a screw to mount the brackets on a wall or door.

The brackets 15, 16 are mounted on a wall or door at a distance apart such that when the openings 12 of the bag are hooked on the projections 21*a*, 21*b*, the bag is opened longitudinally in a direction generally parallel to the sides 10 of the bag and supported on the remaining portions of portions 17*a*, 17*b* adjacent central portions 21*a*, 21*b*.

Figure 3:
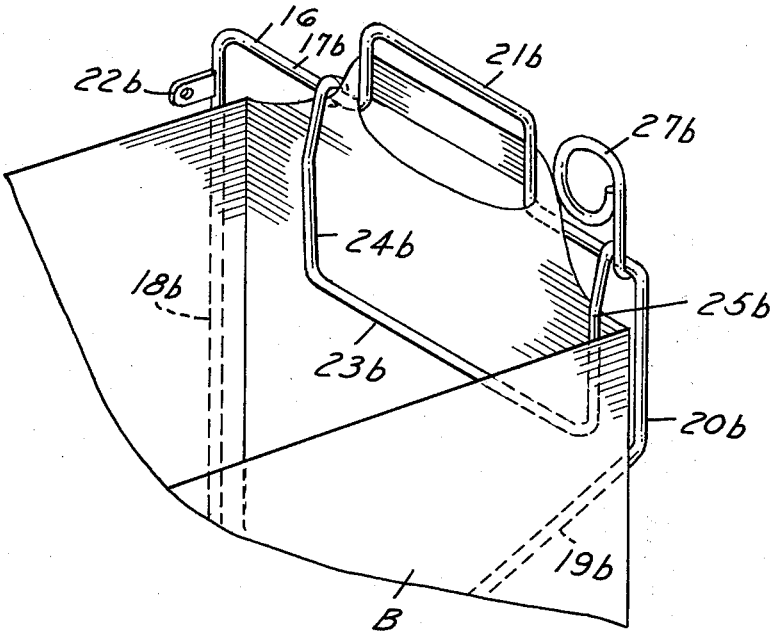
FIG. 3 is a fragmentary perspective view showing the bag in a supported and fully open position.

In addition, each bracket 15, 16 includes means for holding the bag open comprising a member 23*a*, 23*b* made of wire and being generally U-shaped with the legs 24*a*, 25*a* wound around the portions of the horizontal part 17*a*. Members 23*a*, 23*b* are mirror images of one another. Legs 24*a*, 25*a* are bent intermediate their ends so that when the member 23*a* is swung inwardly against the inner surface of the end wall 11, the end wall is forced slightly outwardly (FIG. 3).

Figure 4:
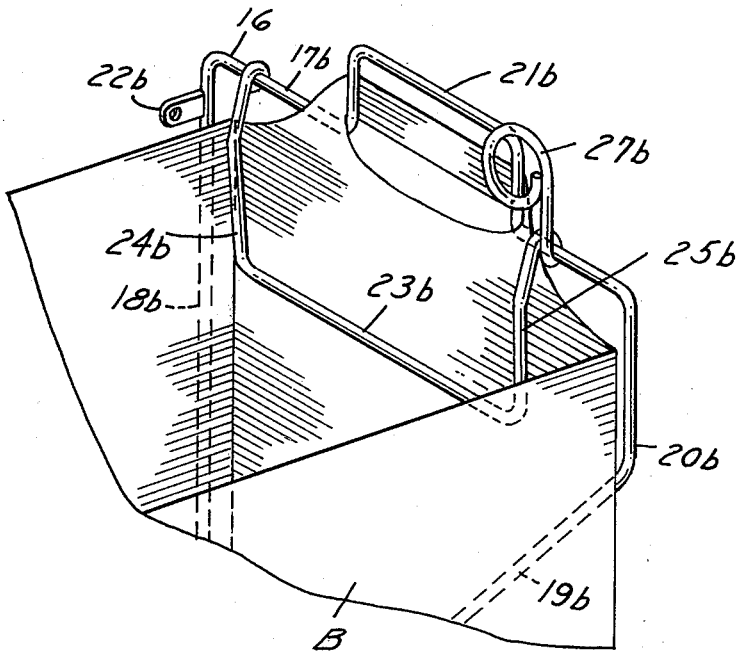
FIG. 4 is a fragmentary perspective view showing the bag in a supported, opened and locked position.

Provision is made for locking the members 23*a*, 23*b* in position and comprises an end portion 27*a*, 27*b* on legs 25*a* that are adapted to be moved together with a member axially behind the upwardly projecting portion 21*a*, 21*b*, respectively, as shown in FIG. 4.

Figure 2:
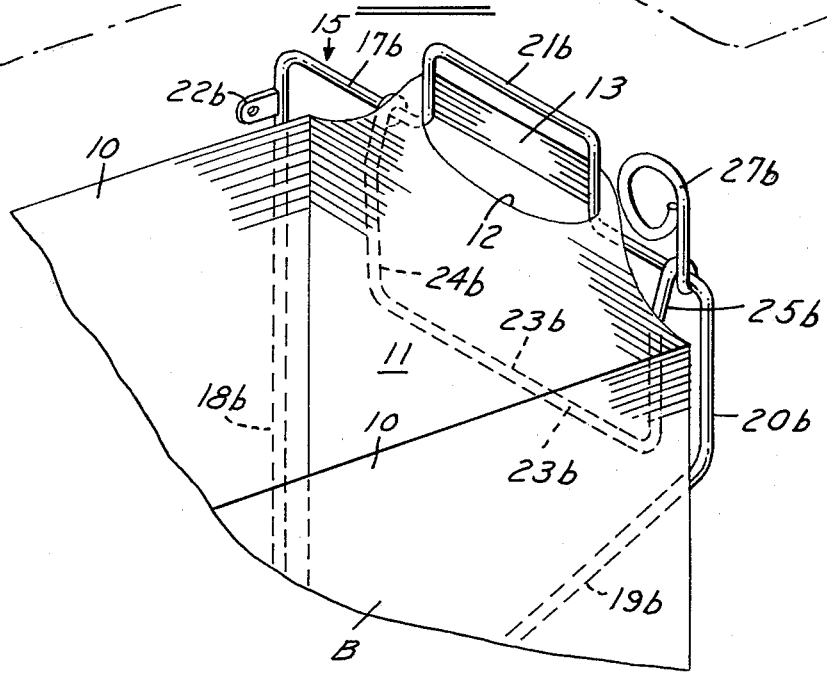
FIG. 2 is a fragmentary perspective view showing the bag in supported position.

With the bag support system comprising the brackets in position on the wall or door, initially, the brackets 23*a*, 23*b* are positioned externally of the bag receiving area (FIG. 2) and the bag is then hung on the projection 21*a*, 21*b* as shown in FIG. 2. The members 23*a*, 23*b* are then swung inwardly as shown in FIG. 3, and then the members are moved longitudinally by sliding them along portions 17*a*, 17*b* toward the wall to lock them against the inner surface of portions 21*a*, 21*b* in position as shown in FIG. 4.

Although in the preferred form the brackets and associated movable bag holding members are made of wire, it is contemplated that they could also be made of plastic or other materials.

I claim:

1. A bag holder support system for a bag having spaced oppositely extending walls with a handle portion formed by an opening in the walls comprising a pair of brackets, said brackets being adapted to be mounted on a wall, door or the like, each bracket having a horizontal portion with a central upwardly extending portion for receiving the handle opening of one side of a bag, said horizontal portion of each bracket extending horizontally away from the upwardly extending portion of each bracket thereby suspending one wall of the bag, and bag holding means on each said bracket movable into position after a bag is suspended on the bracket to hold the wall of the bag in position and maintain the wall so that the bag is held open, means for locking said bag holding means in bag holding position, said bag holding means comprising a second bracket, said locking means comprising a portion of said second bracket cooperating with the upstanding portion of the first mentioned bracket.

2. The bag support system set forth in claim 1 wherein said member is pivoted to said generally horizontal portion.

3. The bag support system set forth in claim 2 wherein said member is movable from a position on one side of the bracket to a position on the other side of the bracket.

4. The bag support system set forth in claim 3 wherein said member includes a free end portion extending at an angle such that it extends into the plane of the wall of the bag when the bag is suspended on the brackets.

5. The bag support system set forth in claim 1 wherein said holding means comprises a wire member.

6. The bag support system set forth in claim 5 wherein said locking means comprises a locking portion of said wire member which is adapted to engage a portion of the bracket to hold the holding wire in position.

7. The bag support system set forth in claim 6 wherein said engagement of said locking portion is achieved by a sliding movement between the bracket and the holding member.

8. A bag holder support system for a bag having spaced oppositely extending walls with a handle portion formed by an opening in the walls comprising a pair of wire brackets, each said bracket comprising a closed wire loop including a horizontal portion with a central U-shaped portion bent upwardly for receiving the opening of one side of a bag, said horizontal portion extending horizontally away from the upwardly extending portion of each bracket thereby suspending one wall of the bag, said brackets having tabs thereon for mounting on a wall, door or the like, and bag holding means on each said bracket movable into position after a bag is suspended on the bracket to hold the wall of the bag in position and maintain the wall so that the bag is held open, said bag holding means comprising a generally U-shaped wire member pivotally mounted on said horizontal portion of each said bracket and movable within the bag after the bag is suspended on the brackets.

9. The bag support system set forth in claim 8 wherein said wire member is movable from a position on one side of the bracket to a position on the other side of the bracket.

10. The bag support system set forth in claim 9 wherein said wire member includes a free end portion extending at an angle such that it extends into the plane of the wall of the bag when the bag is suspended on the brackets.

11. The bag support system set forth in claim 8 including means for locking said wire member in bag holding position.

12. The bag support system set forth in claim 11 wherein said locking means comprises a portion of said wire member cooperating with the upstanding portion of the bracket.

13. The bag support system set forth in claim 12 wherein cooperation of said locking portion is achieved by a sliding movement of said wire member to bring said free end portion into engagement with said upwardly extending portion of said bracket.

14. A bag holder support system for a bag having spaced oppositely extending walls with a handle portion formed by an opening in the walls comprising a pair of brackets, said brackets being adapted to be mounted on a wall, door or the like, each bracket having a horizontal portion with a central upwardly extending portion for receiving the handle opening of one side of a bag, said horizontal portion of each bracket extending horizontally away from the upwardly extending portion of each bracket thereby suspending one wall of the bag, and bag holding means on each said bracket movable into position after a bag is suspended on the bracket to hold the wall of the bag in position and maintain the wall so that the bag is held open, said bag holding means comprising a member pivotally mounted on each said bracket and movable within the bag after the bag is suspended on the brackets.

15. The bag support system set forth in claim 14 including means for locking said bag holding means in bag holding position.

* * * * *